United States Patent [19]

Sahira et al.

[11] Patent Number: 5,019,179

[45] Date of Patent: May 28, 1991

[54] METHOD FOR PLASTIC-WORKING INGOTS OF HEAT-RESISTANT ALLOY CONTAINING BORON

[75] Inventors: Kensho Sahira, Omiya; Toshiki Takeiri; Nobuyoshi Kurauchi, both of Okegawa, all of Japan

[73] Assignee: Mitsubishi Metal Corporation, Tokyo, Japan

[21] Appl. No.: 495,290

[22] Filed: Mar. 19, 1990

[30] Foreign Application Priority Data

| | | | |
|---|---|---|---|
| Mar. 20, 1989 | [JP] | Japan | 1-68868 |
| Mar. 20, 1989 | [JP] | Japan | 1-68869 |
| Mar. 20, 1989 | [JP] | Japan | 1-68870 |

[51] Int. Cl.[5] ..... C22F 1/10

[52] U.S. Cl. ..... 148/11.5 N; 148/313

[58] Field of Search ..... 148/11.5 N

[56] References Cited

U.S. PATENT DOCUMENTS

| | | | |
|---|---|---|---|
| 2,977,223 | 3/1961 | Brown | 148/11.5 N |
| 3,420,716 | 1/1969 | Slepitis | 148/11.5 N |
| 3,519,503 | 7/1970 | Moore et al. | 148/11.5 F |
| 4,401,480 | 8/1983 | Crombie, III | 148/11.5 N |
| 4,820,353 | 4/1989 | Chang | 148/11.5 N |
| 4,820,354 | 4/1989 | Nozmy | 148/11.5 N |
| 4,935,201 | 6/1990 | Inoue et al. | 148/11.5 N |

FOREIGN PATENT DOCUMENTS

| | | |
|---|---|---|
| 0184136 | 6/1986 | European Pat. Off. . |
| 0226458 | 6/1987 | European Pat. Off. . |
| 1214883 | 4/1966 | Fed. Rep. of Germany . |
| 58-73754 | 5/1983 | Japan . |
| 60-100655 | 6/1985 | Japan . |
| 61-153251 | 7/1986 | Japan . |
| 61-153252 | 7/1986 | Japan . |

OTHER PUBLICATIONS

Patent Abstracts of Japan vol. 11, No. 229 (C-436) [2676], Jul. 25, 1987.

Meetham, The Development of Gas Turbine Materials, 1981, pp. 296-298, Applied Science Publishing, London, GB.

*Primary Examiner*—Melvyn J. Andrews
*Assistant Examiner*—David W. Schumaker
*Attorney, Agent, or Firm*—Scully, Scott, Murphy & Presser

[57] ABSTRACT

There is disclosed a method for plastic-working a heat-resistant alloy containing boron, which is in the form of an ingot. The ingot of the alloy is first subjected to hot working. Subsequently, annealing, acid-washing and cold working are carried out on the hot-worked blank material to provide a worked product. The hot working and the annealing are both carried out at a temperature ranging from 1,000° C. to 1,150° C.

4 Claims, 3 Drawing Sheets

METHOD FOR PLASTIC-WORKING INGOTS OF HEAT-RESISTANT ALLOY CONTAINING BORON

BACKGROUND OF THE INVENTION

1. Field of the Invention

The present invention pertains to a method for carrying out a plastic-working on an ingot of a boron-containing heat-resistant alloy without reducing its boron content.

2. Prior Art

It has hitherto been known that boron-containing heat-resistant nickel-based alloys or cobalt-based alloys have strength at high temperatures and superior resistance to oxidation, and that the boron contained therein particularly contributes to improve high-temperature creep characteristics. A typical nickel-based alloy of the aforesaid kind is disclosed in Japanese Patent Publication No. 55-9940, and it contains at least one element selected from the group consisting of 0.04% to 0.25% by weight of carbon (C), 20.0% to 25.0% by weight of chromium (Cr), 16.0% to 20.0% by weight of iron (Fe), 8.0% to 10.0% by weight of molybdenum (Mo), 0.2% to 1.0% by weight of tungsten (W), 0.4% to 1.5% by weight of manganese (Mn), 0.05% to 0.5% by weight of silicon (Si), no greater than 0.02% by weight of boron (B), no greater than 0.1% by weight of aluminum (Al), no greater than 0.02% by weight of titanium (Ti), no greater than 0.6% by weight of cobalt (Co), no greater than 0.05% by weight of zirconium (Zr), no greater than 0.02% by weight of calcium (Ca), and no greater than 0.02% by weight of rare earth metals; balance nickel and unavoidable impurities. Another nickel-based alloy is the one having AMS standard 5536H, which contains 0.05% to 0.15% by weight of carbon, 20.5% to 23.0% by weight of chromium, 17.0% to 20.0% by weight of iron, 8.0% to 10.0% by weight of molybdenum, 0.2% to 1.0% by weight of tungsten, no greater than 1% by weight of manganese, no greater than 1% by weight of silicon, no greater than 0.01% by weight of boron, no greater than 0.5% by weight of aluminum, no greater than 0.15% by weight of titanium, 0.5% to 2.5% by weight of cobalt, no greater than 0.05% by weight of copper (Cu), no greater than 0.04% by weight of phosphorus (P), no greater than 0.03% by weight of sulfur (S), balance nickel and unavoidable impurities. And yet another nickel-based alloy contains 0.08% by weight of carbon, 21% by weight of chromium, 9.0% by weight of molybdenum, 0.003% by weight of tungsten, 0.5% by weight of aluminum, 0.3% by weight of titanium, 12% by weight of cobalt, balance nickel and unavoidable impurities.

When a plastic-working, such as breakdown-forging, hot rolling and cold drawing, is carried out on the nickel-based alloys described above or on other boron-containing heat-resistant alloys, the boron content is substantially decreased. The decrease is particularly severe at a portion adjacent to the surface of the alloy. Therefore, when manufacturing fine wire members, thin plates or tubes with thin walls from ingots of the above boron-containing alloys, the decrease of the boron content becomes crucial, so that the products having a desired boron content and hence desired mechanical characteristics such as high-temperature creep characteristics cannot be obtained.

SUMMARY OF THE INVENTION

It is therefore the object of the invention to provide a method for plastic-working an ingot of a heat-resistant alloy containing boron, by which the alloy ingot can be plastic-worked without reducing the boron content therein.

According to the present invention, there is provided a method for plastic-working an ingot of a heat-resistant alloy containing boron, comprising the steps of:

(a) subjecting the alloy ingot to hot working to produce a blank material; and (b) subsequently carrying out annealing, acid-washing and cold working on the hot-worked blank material to provide a product, wherein the hot working and the annealing are carried out at a temperature ranging from 1,000° C. to 1,150° C.

DETAILED DESCRIPTION OF THE INVENTION

The inventors have made an extensive study to improve the plastic-working method, and have found that a suitable selection of the heat-treating temperature as well as a suitable selection of the kind and content of constituents greatly contributes to the prevention of decrease of boron content during the plastic working operation.

More specifically, the inventors prepared plates of a boron-containing nickel-based alloy each of which was 25 mm in thickness and consisting of 0.08% by weight of carbon, 21.9% by weight of chromium, 9.0% by weight of molybdenum, 50 ppm by weight of boron, 18.5% by weight of iron, 0.45% by weight of tungsten, 0.9% by weight of manganese, 0.3% by weight of silicon, 0.01% by weight of aluminum, 0.01% by weight of titanium, 0.01% by weight of cobalt, 0.001% by weight of zirconium, 0.002% by weight of calcium, balance nickel and unavoidable impurities.

The above alloy plates were heat-treated at temperatures of 1,000° C., 1,050° C., 1,100° C., 1,125° C., 1,150° C., 1,200° C. and 1,250° C. in an air atmosphere for 24 hours. Then, the amount of boron contained in a portion at a depth of 2 mm from the surface for each alloy plate heat-treated at a specific temperature was measured. The results are set forth in FIG. 1, which depicts the relationship between the boron content and heat-treating temperature.

Figure 1:
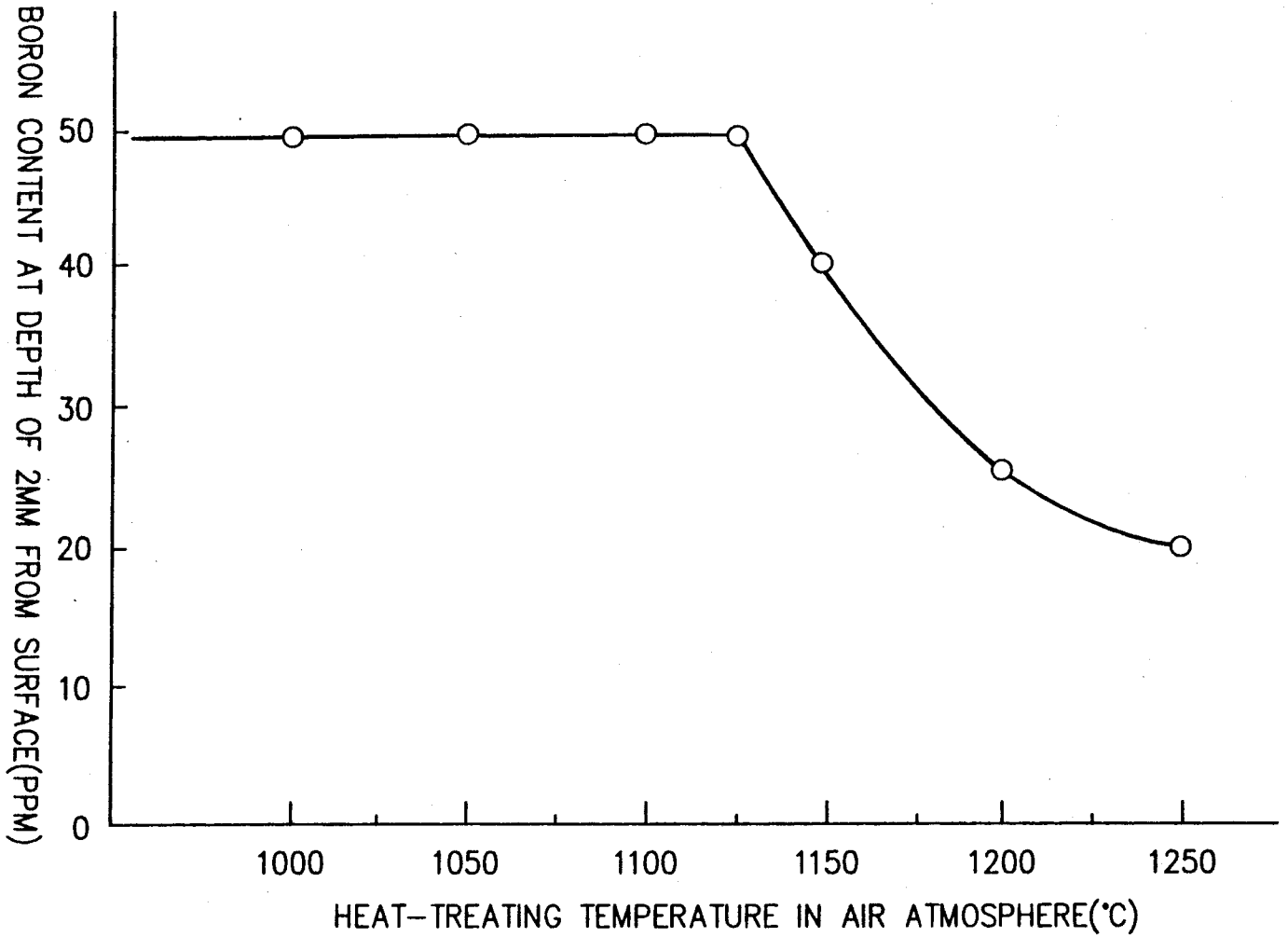
FIG. 1 is a graph showing the relationship between heat-treating temperature in the atmosphere and boron content in the surface of an alloy for explaining one embodiment of the present invention.

It is clear from FIG. 1 that when the heat-treating temperature exceeds 1,125° C., the boron content decreases abruptly, while at temperatures of no greater than 1,125° C., the boron content is substantially the same over the entire range. The above results as to the boron content are funsamentally related to the thermal stability of carbides. Boron may exist in the alloy in the form of a carbide when the heat-treating conditions are such that carbides are stable. In contrast, under heat treating conditions in which a solid solution of carbide is formed, the boron may diffuse at a relatively great speed to the outer surface of the alloy and react with oxygen in the atmosphere to produce oxides which escape from the alloy. The speed of the diffusion may be great when the temperature is high.

Thus, the inventors have come to understand that the boron content can be prevented from decreasing during the plastic-working operation by maintaining the breakdown-forging temperature, hot-rolling temperature, annealing temperature and holding temperature in the final heat treatment at a range of from 1,000° C. to 1,125° C.

Figure 2:
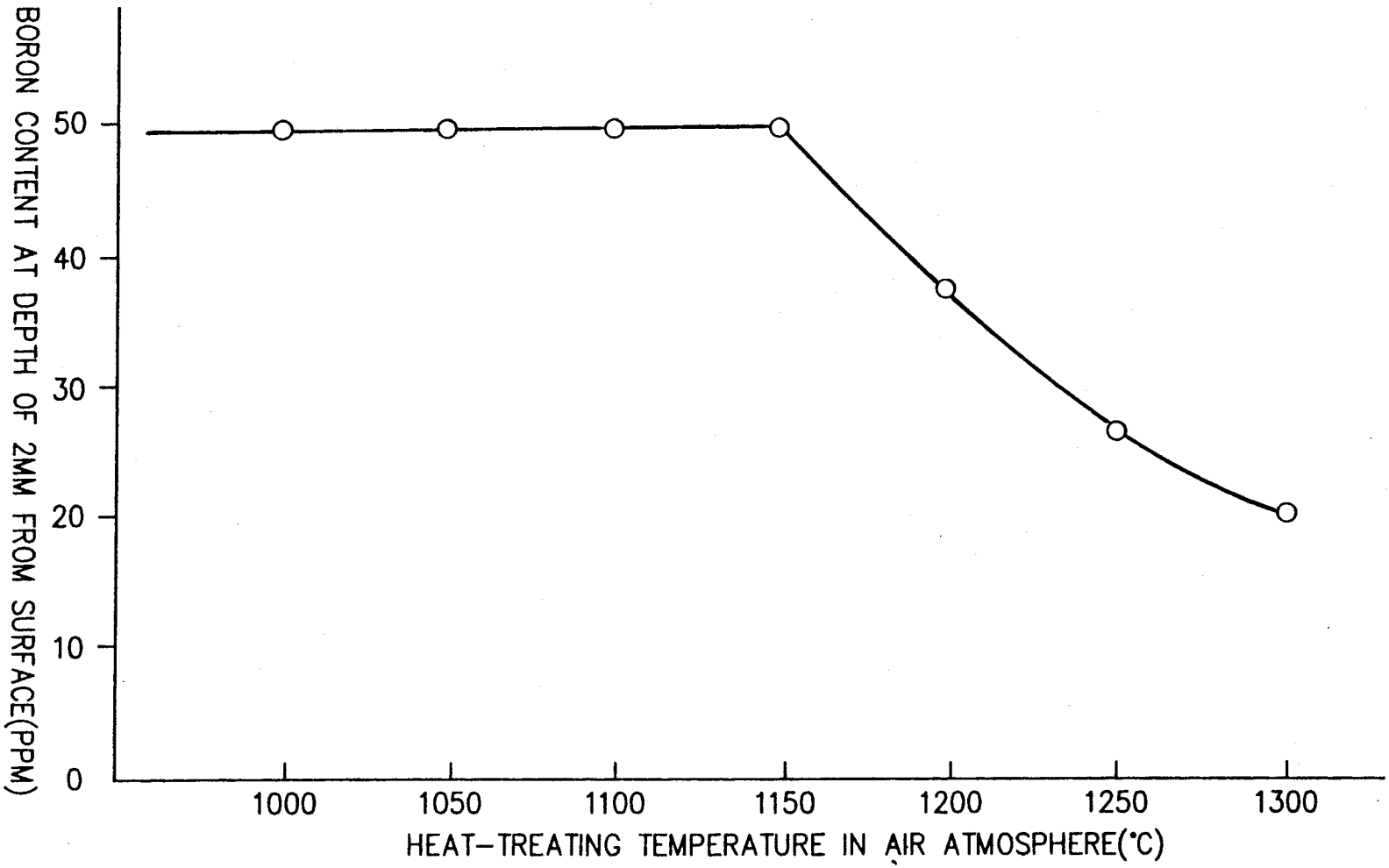
FIGS. 2 and 3 are graphs similar to FIG. 1, but for explaining other embodiments of the invention, respectively.

In addition, as a modification of the above alloy, the inventor prepared plates of a boron-containing nickel-based alloy each of which was 20 mm in thickness and consisting of 0.05% by weight of carbon, 19.4% by weight of chromium, 21.0% by weight of tungsten, 50 ppm by weight of boron, 0.8% by weight of manganese, 0.6% by weight of silicon, 0.05% by weight of aluminum, 0.02% by weight of titanium, 0.02% by weight of zirconium, balance nickel and unavoidable impurities. Then, the plates were heat-treated at temperatures of 1,000° C., 1,050° C., 1,100° C., 1,150° C., 1,200° C., 1,250° C. and 1,300° C. in an air atmosphere for 24 hours, and the amount of boron contained in a portion at a depth of 2 mm from the surface for each alloy plate heat-treated at a specifc temperature was measured. The results are set forth in FIG. 2, from which the inventors have come to understand that when plastic-working the above modified alloy, the boron content can be prevented from decreasing by maintaining the breakdown-forging temperature, hot-rolling temperature, annealing temperature and holding temperature in the final heat treatment at a range of from 1,000° C. to 1,150° C.

Figure 3:
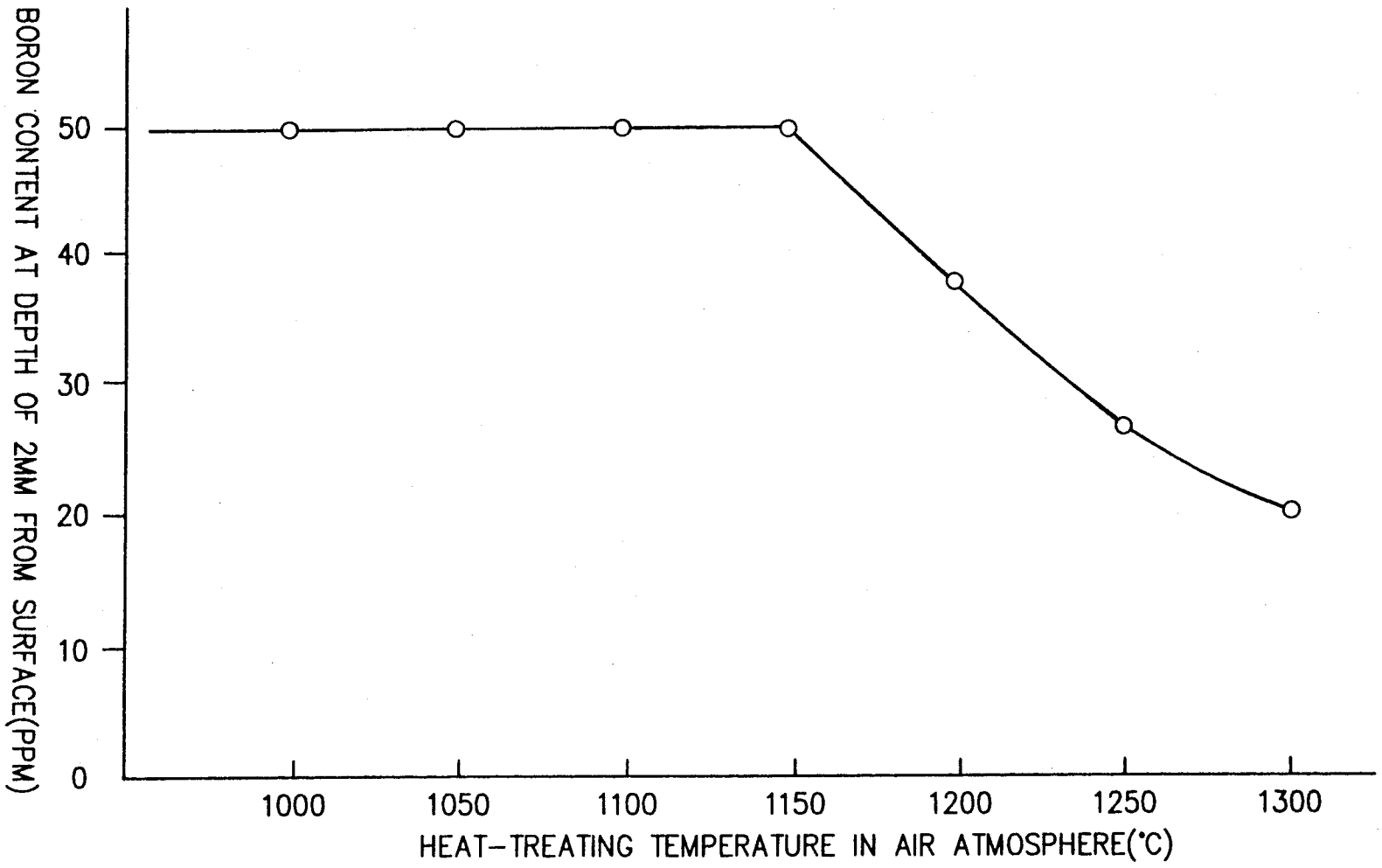

Furthermore, as another modification of the above alloys, the inventors prepared plates of a boron-containing cobalt-based alloy each of which was 25 mm in thickness and consisting of 0.05% by weight of carbon, 20.4% by weight of chromium, 14.8% by weight of tungsten, 50 ppm by weight of boron, 0.3% by weight of manganese, 0.2% by weight of silicon, 0.2% by weight of aluminum, 9.5% by weight of nickel, 0.01% by weight of zirconium, 1.8% by weight of iron, balance cobalt and unavoidable impurities. Then, the plates were heat-treated at temperatures of 1,000° C., 1,050° C., 1,100° C., 1,150° C., 1,200° C., 1,250° C. and 1,300° C. in an air atmosphere for 24 hours, and the amount of boron contained in a portion at a depth of 2 mm from the surface for each alloy plate heat-treated at a specifc temperature was measured. The results are set forth in FIG. 3, from which the inventors have obtained the knowledge that even in the case of the cobalt-based alloy, the boron content can be prevented from decreasing during the plastic-working operation by maintaining the breakdown-forging temperature, hot-rolling temperature, annealing temperature and holding temperature in the final heat treatment at a range of from 1,000° C. to 1,150° C.

The plastic-working method in accordance with the present invention is such that is is possible to process a boron-containing heat-resistant alloy into fine wire members of 8 mm or less in diameter, thin plates of 5 mm or less in thickness, tubes with thin walls of 5 mm or less, or the like in an air atmosphere without reducing their boron content. The method has been developed based on the aforesaid experimental results, and is characterized in that the breakdown-forging temperature, hot-rolling temperature, annealing temperature and holding temperature at the final heat treatment are maintained at a temperature from 1,000° C. to 1,125° C. or from 1,000° C. to 1,150° C.

More specifically, in a first embodiment, the boron-containing nickel-based alloy to be plastic-worked is in the form of an ingot, and contains 0.04% to 0.25% by weight of carbon, 20.0% to 25.0% by weight of chromium, 8.0% to 10.0% by weight of molybdenum and 0.001% to 0.1% by weight of boron as indispensable constituents. The alloy ingot is subjected to breakdown-forging to produce a blank material such as billets or slabs. The blank material is subjected to hot working such as hot forging or hot rolling. Then, the annealing, acid-washing and cold working are repeated to produce fine wire members, tubes with thin walls or thin plates, and, as necessary, a final heat-treatment is carried out.

In the aforesaid nickel-based alloy containing boron, the heat-treating temperature and plastic-working temperature are limited to between 1,000° C. and 1,125° C. If the temperature exceeds 1,125° C., the carbides become unstable, and the boron, which exists within the alloy as a constituent at a solid solution, diffuses at a relatively great speed to the outer surface. On the other hand, if the temperature is less than 1,000° C., the alloy does not get soft enough to alloy the subsequent plastic working operation to be carried out, and cracks may occur in the alloy during the working.

The reason why the contents of the indispensable constituents of the alloy are determined as described above is as follows.

Carbon strengthens the base of the alloy and combines with molybdenum, chromium or the like to produce their carbides which are thermally stable, so that it is an important element to prevent the boron from escaping. If the carbon content is less than 0.04% by weight, the desired effect cannot be obtained. However, if the alloy contains greater than 0.25% by weight of carbon, the performance in the hot working deteriorates and the high-temperature strength is reduced. Thus, the carbon content is set so as to range from 0.04% to 0.25% by weight.

Chromium serves to improve resistance to oxidation at high temperatures and is also important as a constituent for carbide. If its content is less than 20.0% by weight, a sufficient effect cannot be obtained. On the other hand, if the element is added in a content of greater than 25.0% by weight, mechanical characteristics as well as working performance deteriorate. Therefore, the chromium content is limited to from 20.0% to 25.0% by weight.

Molybdenum is effective to enhance the strength of the alloy at high temperatures, and is important as a constituent element for carbide. If its content is less than 8.0% by weight, a sufficient effect cannot be obtained. On the other hand, if the content exceeds 10.0% by weight, cracks tend to occur during hot and cold working operations. Thus, the molybdenum content is set so as to range from 8.0% to 10.0% by weight.

Boron is an important element to ensure strength at high temperatures and sufficient ductility. However, if its content is less than 0.001% by weight, a sufficient effect cannot be obtained. On the other hand, if the content exceeds 0.1% by weight, the performances in hot working as well as in welding operations deteriorate. Accordingly, the boron content is limited to from 0.001% to 0.1% by weight.

In the foregoing, niobium, tantalum and hafnium have the same effect as chromium or molybdenum.

Therefore, if one or more elements selected from niobium, tantalum and hafnium are added in a total amount of less than 5% by weight, boron is more effectively prevented from escaping from the alloy. However, if the above elements are added in an amount of greater than 5% by weight, cracks develop in the alloy during the plastic working.

As a second embodiment an ingot of a boron-containing nickel-based alloy was fabricated which contains 0.02% to 0.25% by weight of carbon, 10.0% to 25.0% by weight of chromium, 10.0% to 25.0% by weight of tungsten and 0.001% to 0.1% by weight of boron as indispensable constituents. The alloy was subjected to various plastic-working operations similar to the first embodiment while maintaining the breakdown-forging temperature, hot-working temperature, annealing temperature and final heat-treating temperature at a range of between 1,000° C. to 1,150° C. In this embodiment, tungsten in the first embodiment is replaced by molybdenum, but molybdenum has the same effect as tungsten and is set to the above range for similar reasons. Furthermore, the composition ranges for the main constituents are different from the first embodiment, but the reasons why the ranges are determined as described above are the same as in the first embodiment. Furthermore, as is the case with the first embodiment, niobium, tantalum and hafnium may further be added in a total amount of less than 5% by weight for the same reasons as described above.

Furthermore, an ingot of a boron-containing cobalt-based alloy to be plastic-worked was fabricated as a third embodiment. The alloy contains 0.02% to 0.25% by weight of carbon, 18.0% to 25.0% by weight of chromium, 13.0% to 17.0% by weight of tungsten and 0.001% to 0.1% by weight of boron as indispensable constituents. The cobalt-based alloy was subjected to various plastic-working operations similar to the previous embodiments while maintaining the breakdown-forging temperature, hot-working temperature, annealing temperature and final heat-treating temperature at a range of between 1,000° C. to 1,150° C. In this embodiment, the composition ranges for the main constituents are different from the first embodiment, but the reasons why the ranges are determined as described above are the same as in the previous embodiments. Furthermore, as are the cases with the previous embodiments, niobium, tantalum and hafnium may further be added in a total amount of less than 5% by weight.

The present invention will now be illustrated by way of examples.

EXAMPLE 1

There was prepared an ingot of a boron-containing nickel-based alloy by carrying out a melting operation in an induction vacuum melting furnace of a capacity of 20kg and a casting operation. The ingot had a composition consisting of 0.10% by weight of carbon, 22.0% by weight of chromium, 0.0080% by weight of boron, 9.2% by weight of molybdenum, 0.7% by weight of tungsten, 0.7% by weight of manganese, 0.4% by weight of silicon, 17.5% by weight of iron, 0.02% by weight of aluminum, 0.04% by weight of titanium, 0.02% by weight of cobalt, 0.005% by weight of zirconium, 0.003% by weight of calcium, balance nickel and unavoidable impurities.

The ingot thus prepared was subjected to breakdown-forging at a temperature of 1,125° C. to produce billets of 10mm in diameter. A billet was held at 1,100° C. for 30 minutes and subjected to hot rolling to produce a round bar of 8.2 mm in diameter. The round bar was held at 1,100° C. for 30 minutes, and subsequently the annealing by water cooling, the acid washing and the cold drawing were successively carried out to reduce the diameter to produce a round bar of 6.2 mm in diameter. The round bar thus produced was held at 1,100° C. for 20 minutes, and the annealing by water cooling, the acid washing and the cold drawing were carried out twice to produce a wire member of 3.2 mm in diameter. Finally, the wire member was held at 1,125° C. for one hour, and the annealing by water cooling, the acid washing and the cold drawing were carried out to produce a fine wire member of 1.6 mm in diameter.

The boron content of the fine wire member thus produced was measured, and was found to be 0.0078% by weight. It is clear from this result that boron does not dissipate during the above operations of processing the ingot into the fine wire member.

EXAMPLE 2

A billet, which was produced in EXAMPLE 1 and was 10 mm in diameter, was employed, and an axial bore of 6 mm in diameter was formed therethrough to produce a blank tube of a boron-containing nickel-based alloy. This blank tube was heated up to 1,050° C. and held for 30 minutes. Then, it was subjected to annealing by water cooling and washed in acid. Subsequently, the tube was subjected to a cold drawing by a cold drawing machine, so that a tube with a thin wall thickness of 1.0 mm was produced.

The boron content of the tube with thin wall was measured and was found to be 0.0080% by weight. It is clear from this result that boron does not dissipate during the above working operations.

EXAMPLE 3

A billet produced in EXAMPLE 1 was subjected to breakdown-forging at a temperature of 1,125° C. to produce a slab of 15 mm in thickness. This slab was subjected to hot rolling at a temperature of 1,100° C. to produce a plate of 7 mm in thickness. This plate was held at a temperature of 1,050° C. for 30 minutes and was annealed by cooling in water. Then, the plate was washed in acid and was subjected to a cold rolling to produce a plate of 4 mm in thickness. The plate was held at a temperature of 1,000° C. for 20 minutes, and the annealing by water cooling, the acid washing and the cold rolling operations were carried out three times to produce a thin plate of 0.5 mm in thickness. Finally, the thin plate was heat-treated at a temperature of 1,100° C. for 20 minutes.

The boron content of the thin plate was measured and was found to be 0.0079% by weight. It is clear from this result that the boron does not dissipate during the above working operations.

COMPARATIVE EXAMPLE 1

There was prepared a nickel-based heat resistant alloy ingot which contained 80 ppm by weight of boron. This ingot was subjected to breakdown-forging at a temperature of 1,180° C. to produce a billet of 10mm in diameter. Thereafter, the billet was held at a temperature of 1,150° C. for 30 minutes. Subsequently, the annealing by water cooling, the acid-washing and the cold drawing were repeatedly carried out thereon at least twice, and it was held at a temperature of 1,180° C. for one hour. Finally, the annealing by water cooling, the acid-washing and the cold drawing were carried out thereon to produce a wire member of 1.6 mm in diameter.

Then, the boron content of the wire member thus produced was measured, and was found to be 5 ppm by weight. This means that 75 ppm by weight of boron disappeared when working the ingot into the wire member.

EXAMPLE 4

There was prepared an ingot of a boron-containing nickel-based alloy by carrying out a melting operation in an induction vacuum melting furnace of a capacity of 20kg and a casting operation. The ingot had a composition consisting of 0.05% by weight of carbon, 21.4% by weight of chromium, 18.9% by weight of tungsten, 0.0085% by weight of boron, 0.5% by weight of manganese, 0.5% by weight of silicon, 0.03% by weight of zirconium, 0.02% by weight of aluminum, 0.01% by weight of titanium, 0.3% by weight of niobium, 0.1 % by weight of molybdenum, balance nickel and unavoidable impurities. The ingot thus prepared was subjected to a breakdown-forging at a temperature of 1,150° C. to produce billets of 10mm in diameter.

A billet was held at 1,130° C. for 30 minutes and annealed by cooling in water. The billet was then washed in acid, and was subjected to hot rolling to produce a round bar of 6.0 mm in diameter. The round bar was held at 1,120° C. for 30 minutes, and the annealing by water cooling, the acid washing and the cold drawing were successively carried out to reduce the diameter to produce a round bar of 4.1 mm in diameter. The round bar thus produced was held at 1,080° C. for 20 minutes and the annealing by water cooling, the acid washing and the cold drawing were carried out three times to produce a wire member of 2.4 mm in diameter. Finally, the wire member was held at 1,140° C. for 30 minutes, and the annealing by water cooling, the acid washing and the cold drawing were carried out to produce a fine wire member of 1.5 mm in diameter.

The boron content of the fine wire member thus produced was measured, and was found to be 0.0083% by weight. It is clear from this result that boron does not dissipate during the above operations of processing the ingot into the fine wire member.

EXAMPLE 5

A billet, which was produced in EXAMPLE 4 and was 10 mm in diameter, was employed, and an axial bore of 6.5 mm in diameter was formed therethrough to produce a blank tube of a boron-containing nickel-based alloy. This blank tube was heated up to 1,120° C. and held for 30 minutes. Then, it was subjected to cold drawing in a cold drawing mill, so that a tube with a thin wall thickness of 0.9 mm was produced.

The boron content of the tube with thin wall was measured and was found to be 0.0085% by weight. It is clear from this result that boron does not dissipate during the above rolling operations.

EXAMPLE 6

A billet produced in EXAMPLE 4 was subjected to breakdown-forging at a temperature of 1,150° C. to produce a slab of 14 mm in thickness. This slab was subjected to hot rolling at a temperature of 1,120° C. to produce a plate of 6.5 mm in thickness. This plate was held at a temperature of 1,120° C. for 30 minutes and was annealed by cooling in water. Then, the plate was washed in acid and was subjected to cold rolling to produce a plate of 4 mm in thickness. The plate thus produced was held at a temperature of 1,000° C. for 20 minutes, and the annealing by water cooling, the acid washing and the cold rolling operations were carried out five times to produce a thin plate of 0.4 mm in thickness. Finally, the thin plate was heat-treated at a temperature of 1,100° C. for 20 minutes.

The boron content of the thin plate thus produced was measured and was found to be 0.0081% by weight. It is clear from this result that boron does not dissipate during the above working operations.

COMPARATIVE EXAMPLE 2

There was prepared a nickel-based heat resistant alloy ingot which contained 80 ppm by weight of boron. This ingot was subjected to breakdown-forging at a temperature of 1,250° C. to produce a billet of 10 mm in diameter. Thereafter, the billet was held at a temperature of 1,200° C. for 30 minutes. Subsequently, the annealing by water cooling, the acid-washing and the cold drawing were repeatedly carried out thereon at least twice, and was held at a temperature of 1,180° C. for 30 minutes. Finally, the annealing by water cooling, the acid-washing and the cold drawing were carried out to produce a wire member of 1.6 mm in diameter.

Then, the boron content of the wire member thus produced was measured, and was found to be 5 ppm by weight. This means that 75 ppm by weight of boron were removed from the wire member when working the ingot into the wire member.

EXAMPLE 7

There was prepared an ingot of a boron-containing nickel-based alloy by carrying out a melting operation in an induction vacuum melting furnace of a capacity of 20kg and a casting operation. The ingot had a composition consisting of 0.05% by weight of carbon, 21.0% by weight of chromium, 4.3% by weight of tungsten, 0.0070% by weight of boron, 9.0% by weight of nickel, 0.2% by weight of manganese, 0.1% by weight of silicon, 0.3% by weight of aluminum, 1.5% by weight of iron, 0.01% by weight of zirconium, balance cobalt and unavoidable impurities. The ingot thus prepared was subjected to breakdown-forging at a temperature of 1,150° C. to produce billets of 10 mm in diameter.

A billet was held at 1,120° C. for 30 minutes and was subjected to hot rolling to produce a round bar of 6.2 mm in diameter. The round bar was then held at 1,120° C. for 30 minutes, and the annealing by water cooling, the acid washing and the cold drawing were successively carried out thereon to reduce its diameter to 4.2 mm. The round bar thus produced was held at 1,100° C. for 20 minutes and the annealing by water cooling, the acid washing and the cold drawing were carried out three times to produce a wire member of 2.2 mm in diameter. Finally, the wire member was held at 1,140° C. for one hour, and the annealing by water cooling, the acid washing and the cold drawing were carried out to produce a fine wire member of 1.6 mm in diameter.

The boron content of the fine wire member of cobalt-based alloy thus produced was measured, and was found to be 0.0070% by weight. It is clear from this result that boron does not dissipate when processing the ingot into the fine wire member.

EXAMPLE 8

A billet, which was produced in EXAMPLE 4 and was 10 mm in diameter, was employed, and an axial bore of 6.5 mm in diameter was formed therethrough to produce a blank tube of a boron-containing cobalt-based alloy. This blank tube was heated up to 1,100° C. and held for one hour. Then, the tube was subjected to a cold drawing in a cold drawing mill, so that a tube with thin wall thickness of 1.0 mm was produced.

The boron content of the tube with thin wall thus produced was measured and was found to be 0.0068% by weight. It is clear from this result that boron does not dissipate during the above rolling operations.

EXAMPLE 9

A billet produced in EXAMPLE 7 was subjected to breakdown-forging at a temperature of 1,150° C. to produce a slab of 15 mm in thickness. This slab was subjected to hot rolling at a temperature of 1,125° C. to produce a plate of 8 mm in thickness. This plate was held at a temperature of 1,100° C. for 30 minutes and was annealed by cooling in water. Then, the plate was washed in acid and was subjected to a cold rolling to produce a plate of 5 mm in thickness. The plate was held at a temperature of 1,020° C. for 20 minutes, and the annealing by water cooling, the acid washing and the cold rolling operations were carried out six times to produce a thin plate of 0.6 mm in thickness. Finally, the thin plate was heat-treated at a temperature of 1,100° C. for 20 minutes.

The boron content of the thin plate thus prepared was measured and was found to be 0.0069% by weight. It is clear from this result that boron does not dissipate during the above plastic-working operations.

COMPARATIVE EXAMPLE 3

There was prepared a cobalt-based heat resistant alloy ingot which contained 50 ppm by weight of boron. This ingot was subjected to breakdown-forging at a temperature of 1,250° C. to produce a billet of 10 mm in diameter. Thereafter, the billet was held at a temperature of 1,180° C. for 30 minutes. Subsequently, the annealing by water cooling, the acid-washing and the cold drawing were repeatedly carried out thereon at least twice. Finally, the member was held at a temperature of 1,200° C. for one hour, and the annealing by water cooling, the acid-washing and the cold drawing were successively carried out to produce a wire member of 1.6 mm in diameter.

Then, the boron content of the wire member thus produced was measured, and was found to be 5 ppm by weight. This means that 48 ppm by weight of boron disappeared from the alloy when working the ingot into the wire member.

What is claimed is:

1. In an improved method for plastic-working a heat-resistant alloy containing boron, said alloy being in the form of an ingot, comprising the steps of:

(a) subjecting the ingot of said alloy to hot working to produce a blank material; and (b) subsequently carrying out annealing, acid-washing and cold working on the hot-worked blank material to provide a worked product, the improvement comprising carrying out said hot working and said annealing at a temperature ranging from 1,000° C. to 1,150° C., wherein said alloy is a nickel-based alloy which contains 0.02% to 0.25% by weight of carbon, 10.0% to 25.0% of chromium, 10.0% to 25.0% by weight of tungsten and 0.001% to 0.1% by weight of boron as indispensable constituents.

2. In an improved method for plastic-working a heat-resistant alloy containing boron, said alloy being in the form of an ingot, comprising the steps of:

(a) subjecting the ingot of said alloy to hot working to produce a blank material; and (b) subsequently carrying out annealing, acid-washing and cold working on the hot-worked blank material to provide a worked product, the improvement comprising carrying out said hot working and said annealing at a temperature ranging from 1,000° C. to 1,150° C., wherein said alloy is a cobalt-based alloy which contains 0.02% to 0.25% by weight of carbon, 18.0% to 25.0% of chromium, 13.0% to 17.0% by weight of tungsten and 0.001% to 0.1% by weight of boron as indispensable constituents.

3. A plastic-working method as defined in claim 1, further comprising subjecting the product processed in said step (b) to a final heat treatment, said final heat treatment being carried out at a temperature ranging from 1,000° C. to 1,150° C.

4. A plastic-working method as defined in claim 2, further comprising subjecting the product processed in said step (b) to a final heat treatment, said final heat treatment being carried out at a temperature ranging from 1,000° C. to 1,150° C.

* * * * *